US005792980A

United States Patent [19]

Weimann

[11] Patent Number: 5,792,980

[45] Date of Patent: Aug. 11, 1998

[54] PRODUCING EXPLOSIVE-FORMED PROJECTILES

[75] Inventor: Klaus Weimann, Rümmingen, Germany

[73] Assignee: Fraunhofer-Gesellschaft zur Forderung der ange-wandten Forschung e.v., Munich, Germany

[21] Appl. No.: 535,949

[22] Filed: May 21, 1990

Related U.S. Application Data

[63] Continuation of Ser. No. 92,773, Aug. 21, 1987, abandoned.

[30] Foreign Application Priority Data

Aug. 22, 1986 [DE] Germany ..... 36 28 622.2

[51] Int. Cl.[6] ..... F42B 12/10

[52] U.S. Cl. ..... 102/476; 102/438; 102/501; 102/517

[58] Field of Search ..... 102/306–310, 102/438, 476, 501, 517–519

[56] References Cited

U.S. PATENT DOCUMENTS

| | | | |
|---|---|---|---|
| 3,025,794 | 3/1962 | Lebourg et al. | 102/307 |
| 3,224,368 | 12/1965 | House | 102/307 |
| 3,439,613 | 4/1969 | Thomanek | 102/476 |
| 3,695,141 | 10/1972 | Kronman et al. | 102/501 |
| 3,862,600 | 1/1975 | Tocco | 102/438 |
| 4,041,866 | 8/1977 | Thevenin et al. | 102/306 |
| 4,498,367 | 2/1985 | Skolnick et al. | 102/306 |
| 4,499,830 | 2/1985 | Majerus et al. | 102/476 |
| 4,590,861 | 5/1986 | Bugiel | 102/501 |
| 4,649,828 | 3/1987 | Henderson et al. | 102/476 |
| 4,714,019 | 12/1987 | Lips et al. | 102/307 |
| 4,776,272 | 10/1988 | Lindstadt et al. | 102/307 |
| 4,982,667 | 1/1991 | Weimann | 102/476 |
| 5,033,387 | 7/1991 | Lips | 102/476 |

FOREIGN PATENT DOCUMENTS

| | | | |
|---|---|---|---|
| 878636 | 8/1971 | Canada | 102/501 |
| 1209463 | 1/1966 | Germany | 102/476 |
| 1910779 | 10/1979 | Germany . | |
| 2913103 | 1/1980 | Germany . | |
| 3317352 | 11/1984 | Germany . | |

*Primary Examiner*—Harold J. Tudor
*Attorney, Agent, or Firm*—Antonelli, Terry, Stout & Kraus, LLP

[57] ABSTRACT

A device for the production of explosive formed projectiles includes a casing with an explosive filling, an ignition device arranged at the bottom and a disc-shaped metal insert covering the top of the explosive filling. In order to produce several projectiles or a single projectile composed of several such projectiles with a large l/d ratio, the insert includes at least two discs, arranged directly behind each other.

11 Claims, 3 Drawing Sheets

PRODUCING EXPLOSIVE-FORMED PROJECTILES

This is a continuation of application Ser. No. 092,773, filed Aug. 21, 1987, now abandoned.

BACKGROUND OF THE INVENTION

The invention concerns a device for the production of explosive-formed projectiles including a casing with a filling of explosive, an ignition device arranged on the bottom side and a disc shaped insert of metal, covering the top of the explosive filling.

Devices of the above type are known, in their most simple form, as a shaped charge. In such a shaped charge the casing is generally cylindrically round. Upon ignition of the explosive the insert is split into individual particles which then move in a projectile-type way towards the firing object. In practice as described, for example, in DE-AS 19 10 779, this is attained by the fact that with a certain shaping the insert is split into several small particles, the so-called stream and into one or several large particles, the so-called plunger. Such an insert has, for example, a cone shape with a cone angle ≦80°. A smaller number of elongated particles can be produced when the insert has a concentrically predetermined breaking point, along which the insert is preferably split.

Apart from this, devices of the type described in, for example, DE-OS 29 13 103, 33 17 352 have been recently developed with the aid of which individual projectiles are obtained by explosive-forming. For this purpose disc-shaped inserts are used which are slightly bent, whereby the goal is, to reshape this total insert into a single elongated projectile and to provide this projectile at the same time with a high discharge speed in order to develop high impact energy at the impact site. In order to also attain stable flight properties, the ratio length/diameter (1/3) should be as large as possible. In addition, provisions should be made that during the explosive-forming a defined projectile shape is obtained, primarily in the head and rear area. For this purpose inserts have been suggested in, for example, DE-OS 33 17 352 which, on their side removed from the explosive filling, are facet shaped, so that there are zones with varying material thicknesses. During the detonation of the explosive, certain areas of the metallic insert bend at varying times with the result that the insert is symmetrically folded and a projectile with a winglike rear shape formed.

In, for example, unpublished DE patent 33 29 969, a defined and axis-symmetrical projectile shape is attained by the fact that the time of impact and/or energy of impact of the shock wave is directed towards the insert. This can be attained by the fact that one of the components forming the device, casing, explosive filling, ignition device or insert has at least three non-uniformities, arranged at a distance from the axis of the device. For example, non-uniformities are provided on the casing by shaping it, for example, cylindrically round on the inside, but polygonal on the outside, which causes a varying lateral tamping which, in turn, leads to a varying energy transmission to the insert.

In all the above cited embodiments, relatively narrow limits are set for the effectiveness of the impact energy of the projectile at its destination due to the limited mass of the insert and/or an l/d ratio, limited to maximum 5:1.

The aim underlying the present invention essentially resides in further developing the device of the type cited in the beginning in such a manner that projectiles with a greater penetration force are obtained.

According to the invention this problem is solved by the fact that the insert includes at least two discs arranged directly behind each other.

For increasing the penetration force it would seem to be appropriate to increase the length of the known individual projectiles. However, practice has shown that this leads to overextension during the explosive-forming with the effect that the projectile is split up.

With the device according to the invention, depending on the number of discs, two or several individual projectiles are formed which are accelerated to slightly differing discharge speeds, whereby their distance first enlarges and then remains about constant with a relatively low value. Two or more such projectiles are more effective than a single projectile and this even then when the total energy of the several projectiles is equal to that of the single projectile.

Practical experiments have also shown that with an absolutely symmetrical structure of the components of the device the flight path of the two or several projectiles aligns over long flight distances so that they hit the target at almost the same spot. This makes the device according to the invention particularly suitable for fighting reactive armor due to the fact that the projectile which first impacts the target stimulates and uses up the reactive layer and the second projectile then impacts the bare armor.

Slight non-uniformities on the device permit the attainment of a directional effect in such a manner that the resulting projectiles depart in slightly diverging flight directions, thus providing a slight dispersion. This embodiment is particularly recommended for use against light armor with a simultaneous increase in impact probability.

Finally, the invention also provides the possibility, with a corresponding design and arrangement of the discs forming the insert, to have the blast shaping proceed in such a manner that one projectile is formed from each disc, but that these projectiles are somehow shaped on top of each other and thus "interlocked" so that in reality there are not several, but one single projectile of about the same diameter but with considerably greater length. This makes it possible to obtain a l/d ratio considerably greater than 5:1, as is the case with individual projectiles.

It is possible to influence the impact energy, the penetration force and the flight properties in various manners. It is possible, for example, that the discs have varying thicknesses and/or varying specific weights in order to provide them with varying mass. For the two or several discs it is possible to use the same or different materials.

When using the discs with different mass, it is preferred that the disc with the greatest mass is arranged on the side of the explosive filling. If more than two discs with different mass are provided, the discs are arranged behind each other in the sequence of their mass with the disc with the greatest mass on the side of the explosive filling. As compared to the reverse sequence, this arrangement has the advantage that there is a more even distribution of energy among the projectiles. However, if it is desired to deliberately provide the projectiles with strongly different impact energy, a reversal of the arrangement is recommended.

Another measure for influencing is the manner in which the discs are arranged. It is possible, for example, that they are placed tightly against each other or even joined, e.g., pressed together, glued or similar. If, with this arrangement, provisions are made that the projectiles do not separate after explosive-forming, but remain interlocked, it is possible, e.g., that the resulting multilayered projectiles can be made with a light outer layer, such as of iron (outer disc) and a heavy core, such as heavy metal (inner disc), which, in turn, would have a favorable impact on the flight behavior.

Instead of this it is possible to arrange a separate layer between the discs which encourages a faultless separation of the projectiles on discharge. This separating layer may include, for example, an air gap, foil or similar material. The separating layer does not have to extend over the full space of the disc.

As already suggested in the above-mentioned unpublished German patent 33 29 969, it is possible that, for influencing the projectile shape, at least one of the components forming the device, namely the casing, the explosive filling, the ignition device or insert, has at least three non-uniformities, arranged at a distance from the axis of the device. These non-uniformities have the expressed purpose of assuring this faultless shaping of the insert into one or more flight-stable projectiles. In the individual case it is generally sufficient if, for example, only one of the discs forming the insert has these non-uniformities.

Further details and advantages of the invention can be seen from the description of the embodiments shown in the accompanying drawings.

DETAILED DESCRIPTION

Figure 1:
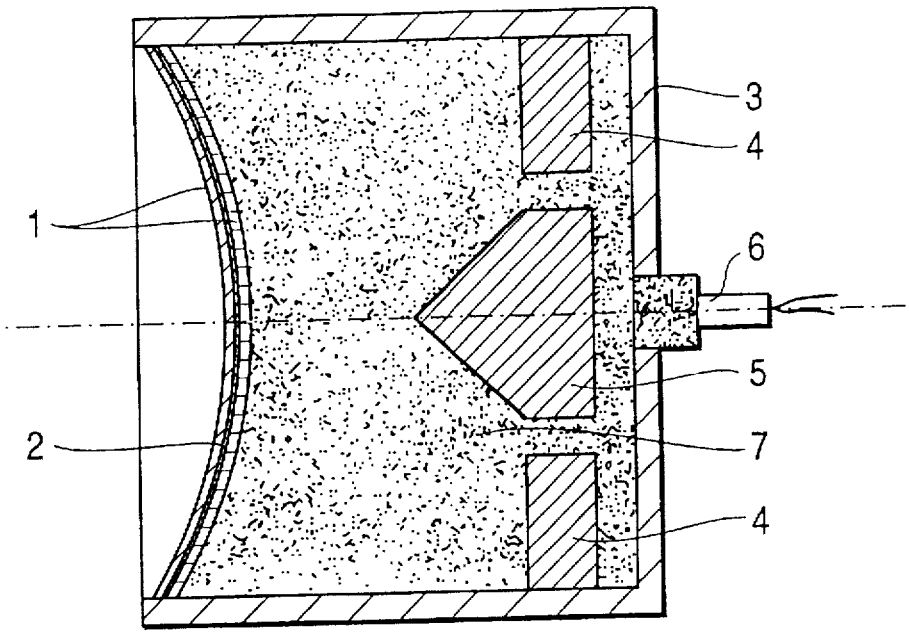
FIG. 1 is an axial cross section through a first embodiment of the device.
Figure 2:
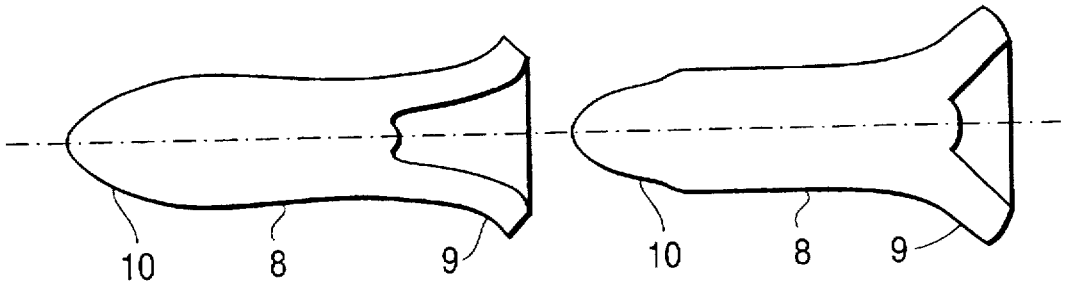
FIG. 2 is an axial cross-section of the projectile produced with a device according to FIG. 1.

The device shown in FIGS. 1 and 2 shows a box-shaped casing 3, filled with explosive material 7, covered on top by inserts 1. On the bottom of the casing 3 an ignition device 6 is arranged, while inside casing 3, in the area near the bottom, there are non-uniformities 4 which, as suggested earlier, influence in a defined way the explosive-forming of the inserts 1 into projectiles. In the embodiment of FIG. 1 the non-uniformities 4 are built-in members or elements eventually lead to non-uniformities in the explosive material loading.

Figure 5:
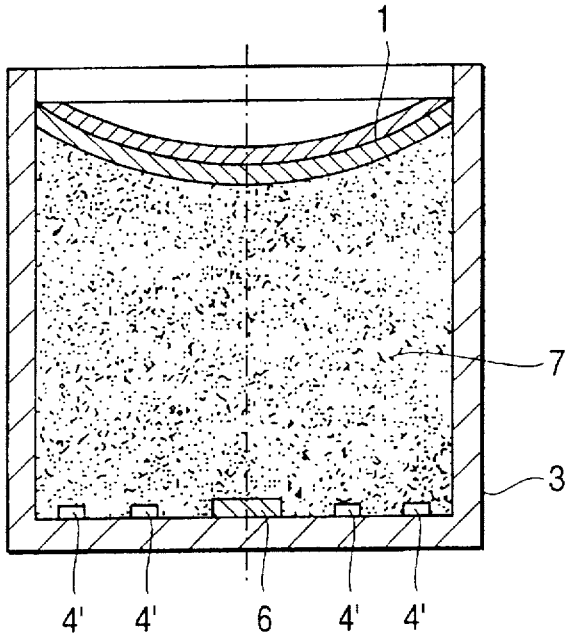
FIG. 5 is a longitudinal cross-sectional view through another embodiment of the present invention.

As shown in FIG. 5, non-uniformities 4' can be provided on the ignition device 6 wherein at least three ignition points of varied ignition energy or different ignition delay arranged asymmetrically supportive way in a conventional manner as described, for example, in the above mentioned DE 33 29 969 and corresponding to U.S. Pat. No. 4,982,667.

Figure 6:
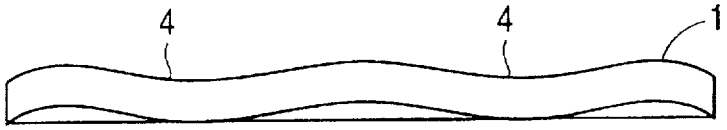
FIG. 6 is a side is a side view of an insert with inhomogeneities utilizable in the present invention.
Figure 7:
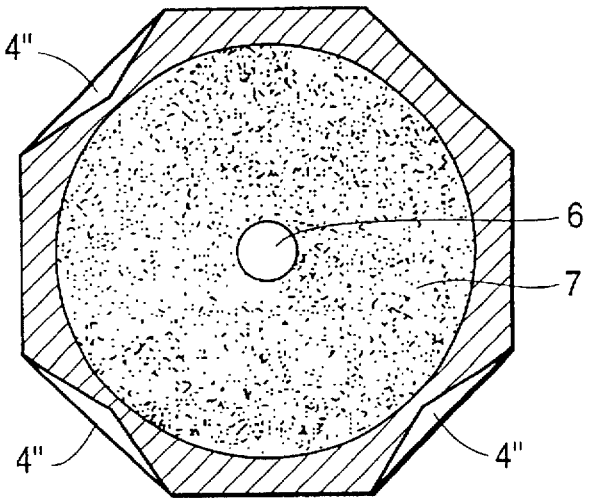
FIG. 7 is a cross-sectional view of yet another embodiment of the present invention.

As shown in FIGS. 6 and 7, it is also possible to broaden non-uniformities or inhomogeneities in the inserts 1 in the form of wavy deformations or, as shown in FIG. 7, asymmetrically disposed surfaces 4" in the casing in a conventional manner as also described in DE Patent 33 29 969 and corresponding U.S. Pat. No. 4,982,667.

In addition, the casing 3 has, in its central area, a baffle 5 which serves for guiding the detonation wave for the production of perfect projectiles, but not always and not absolutely necessary.

The inserts 1 in the embodiment according to FIG. 1 include two concave and essentially parallel discs of the same thickness, between which a separating layer 2 is arranged, including, for example, of a full or partial air gap, of foil or similar material. It may also be of a material which joins the two disc-shaped inserts 1 such as, for example, adhesive or similar material.

When the ignition device 6 is operated, the two disc-shaped inserts 1 are shaped into projectiles 8 (FIG. 2) by the detonation wave. Each insert is shaped into a projectile. Both projectiles have an ogivally-shaped head area 10 and an outwardly curving rear area 9. These two areas are essential for the flight properties and designed in particularly favorable manner. If the inserts 1 are arranged in the manner shown in FIG. 1, two individual projectiles are formed which follow each other at a relatively short distance.

Figure 3:
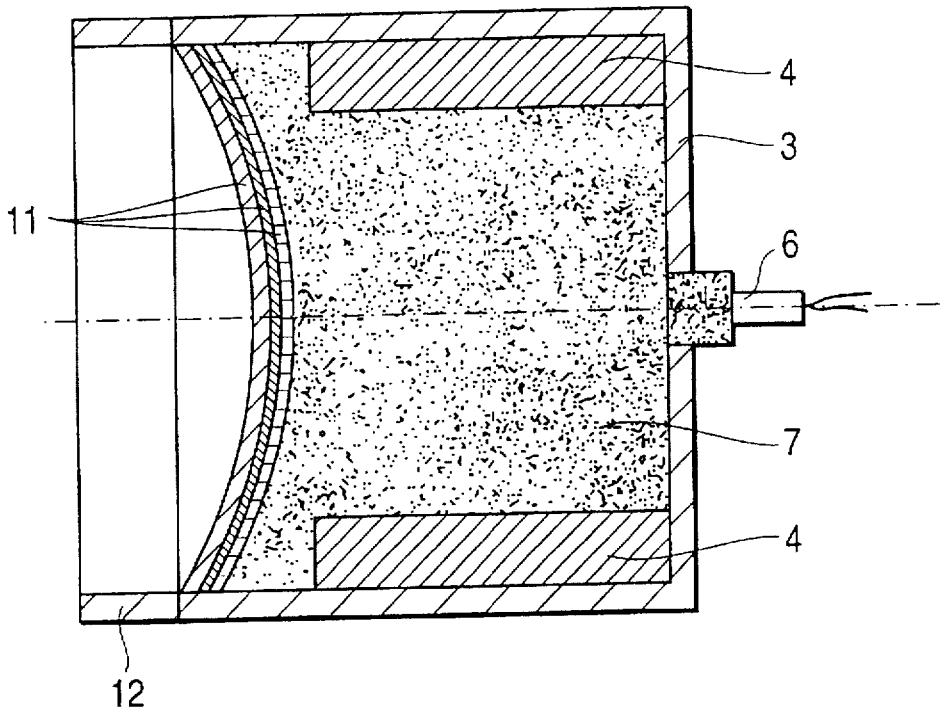
FIG. 3 is an axial cross section of another embodiment of the device.

The device according to FIG. 3 also has a casing 3, non-uniformities 4, an ignition device 6 and an explosive filling 7. The latter is covered on top by concave disc-shaped inserts 11. In this embodiment a jacket of the casing 3 is additionally pulled forward over the inserts into area 12.

The embodiment according to FIG. 3 has a total of three disc-shaped inserts with small differences in their thicknesses. The insert with the greatest thickness is here placed on the outside, away from the explosive filling 7, while the two other inserts follow in sequence of their thickness towards the inside. In another variation from FIG. 1, the non-uniformities 4 include baffles which essentially provide for a stronger lateral confinement, whereby the pulled forward area 12 also represents an additional confinement.

Figure 4:
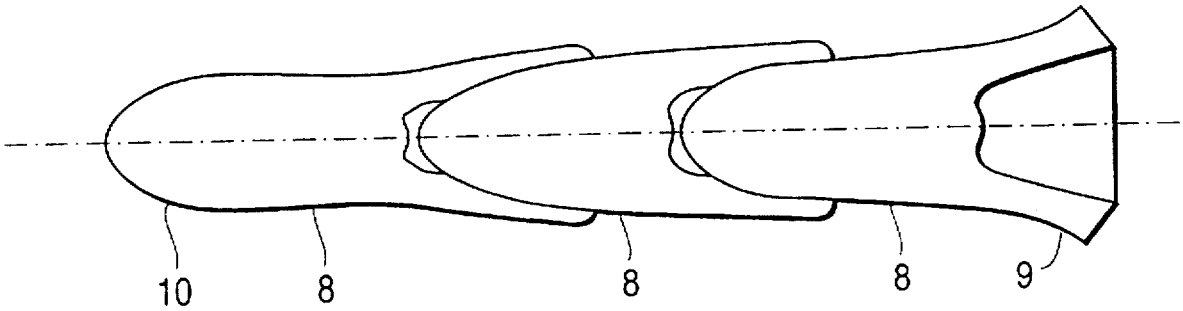
FIG. 4 is an axial cross section of the projectile produced by the device according to FIG. 3.

After the activation of the ignition device 6, the inserts 11 are shaped by the detonation wave of the explosive filling 7 in the manner shown in FIG. 4. The result is a projectile, composed of several individual projectiles 8, which are pushed on top of each other in such a manner that the rear area of one projectile firmly surrounds the head area of the subsequent projectile. The front projectile 8 again has an ogival shape of the head area 10, while the last projectile has an outwardly bent rear area. These interlocked projectiles 8 form a single projectile with a correspondingly greater length. The joint between the individual projectiles 8 is strong enough that it will not let go even during the flight phase.

While the last projectile has an outwardly bent rear area. These interlocked projecties 8 form a single projectile with a correspondingly greater length. The joint between the individual projectiles 8 is strong enough that it will not let go even during the flight phase.

I claim:

1. A device for producing explosive-formed projectiles including a casing filled with an explosive, an ignition device arranged on a bottom side of said casing and a metal insert covering a top of the explosive filling, wherein the insert comprises at least two metal discs arranged directly behind each other, and wherein at least three means arranged along a circle at a distance from a longitudinal center axis of the casing are provided for influencing the explosive formation of at least two projectiles from the respective discs and also the shaping of the projectiles, said means for influencing being provided in at least one of the casings, the explosive filling, the ignition device and the insert and one of the discs having a greater mass than the other disc and being arranged on a side of the explosive filling.

2. A device according to claim 1, wherein said at least two discs comprise more than two discs of varying mass, the respective discs being arranged in a sequence based on their mass one behind each other, with the disc with the greatest mass being disposed on the side of the explosive filling.

3. A device according to claim 1, wherein the discs are placed tightly together.

4. A device according to claim 1, wherein the discs are joined by being pressed together.

5. A device according to claim 1, wherein a separating layer is arranged between each of the discs.

6. A device according to claim 5, wherein the separating layer is formed by foil.

7. A device according to claim 1, wherein the discs have varying thicknesses.

8. A device according to claim 3, wherein the discs are joined together by an adhesive material.

9. A device according to claim 1, wherein the insert comprises at least two metal discs in contact with each other and wherein the explosive-formed projectiles are arranged one directly behind the other in the direction of flight.

10. A device according to claim 9, wherein the explosive-formed projectiles are interlocked one behind the other.

11. A device according to claim 1, wherein the at least two metal discs each extend entirely across the explosive filling.

* * * * *